US012383819B1

(12) United States Patent
Tian

(10) Patent No.: US 12,383,819 B1
(45) Date of Patent: Aug. 12, 2025

(54) LIFTABLE AND ROTATABLE JIGSAW PUZZLE TABLE

(71) Applicant: Tian

(72) Inventor: Zhiguang Tian, Zhongshan (CN)

( * ) Notice: Subject to any disclaimer, the term of this patent is extended or adjusted under 35 U.S.C. 154(b) by 0 days.

(21) Appl. No.: 19/030,643

(22) Filed: Jan. 17, 2025

(51) Int. Cl.

| | |
|---|---|
| ***A63F 9/10*** | (2006.01) |
| ***A47B 9/10*** | (2006.01) |
| ***A47B 13/08*** | (2006.01) |
| ***A47B 37/00*** | (2006.01) |

(52) U.S. Cl.
CPC ..... *A63F 9/1044* (2013.01); *A47B 9/10* (2013.01); *A47B 13/081* (2013.01); *A47B 37/00* (2013.01); *A63F 2009/105* (2013.01)

(58) Field of Classification Search
CPC ..... A63F 9/1044; A47B 9/10; A47B 11/00
USPC ..... 108/141
See application file for complete search history.

(56) References Cited

U.S. PATENT DOCUMENTS

| | | | | | |
|---|---|---|---|---|---|
| 1,963,467 | A * | 6/1934 | Keller | A47B 11/00 | 108/150 |
| 3,862,735 | A * | 1/1975 | Cohen | A47F 5/02 | 248/405 |
| 4,793,266 | A * | 12/1988 | Napolitano | A21C 15/002 | 108/139 |
| 5,479,867 | A * | 1/1996 | Blevins | A47B 49/00 | 108/22 |
| 6,182,583 | B1 * | 2/2001 | Larson | A47C 3/30 | 108/150 |
| 11,388,990 | B1 * | 7/2022 | Watkins | A63F 9/1044 | |
| 2001/0047742 | A1 * | 12/2001 | Moore | A47B 17/00 | 108/50.01 |
| 2007/0266913 | A1 * | 11/2007 | Hardt | A47B 21/0371 | 108/50.01 |
| 2009/0045311 | A1 * | 2/2009 | Seyedin | F16M 11/08 | 248/349.1 |
| 2014/0360412 | A1 * | 12/2014 | Zaccai | A47B 23/046 | 108/142 |
| 2017/0350552 | A1 * | 12/2017 | James | F16M 11/08 | |
| 2019/0191866 | A1 * | 6/2019 | Lin | A47B 9/20 | |
| 2020/0240575 | A1 * | 7/2020 | Lee | F16M 13/022 | |
| 2021/0170268 | A1 | 6/2021 | Malki | | |
| 2023/0356070 | A1 * | 11/2023 | Che | A63F 9/1044 | |
| 2023/0371684 | A1 * | 11/2023 | Ozagir | A47B 9/20 | |
| 2024/0117540 | A1 * | 4/2024 | Houck | D05B 11/00 | |

* cited by examiner

*Primary Examiner* — Jose V Chen
(74) *Attorney, Agent, or Firm* — Ying-Ting Chen; Law Office of Michael Chen

(57) ABSTRACT

A liftable and rotatable jigsaw puzzle table includes a jigsaw bottom plate, a center member provided on the bottom of the jigsaw bottom plate, a sleeve installed in the middle of the center member, a fixed member rotatably installed at bottom of the jigsaw bottom plate, a sleeve rod provided within the sleeve and installed on the top of the fixed member, a ball bearing rotatably provided on the bottom of the sleeve, an annular groove provided at the center member, a plurality of positioning holes evenly provided in the annular groove, a positioning cylinder installed on the fixed member, a positioning rod slidably provided in the positioning cylinder, a top pressure spring installed on the positioning rod, a top pipe at the bottom of the fixed member, a bottom pipe sleeved on the top pipe, and a gas spring in the top pipe and bottom pipe.

6 Claims, 9 Drawing Sheets

LIFTABLE AND ROTATABLE JIGSAW PUZZLE TABLE

FIELD OF THE INVENTION

The invention relates to the technical field of jigsaw puzzle tables, and in particular to a liftable and rotatable jigsaw puzzle table.

BACKGROUND OF THE INVENTION

Jigsaw puzzles are a kind of DIY toys that combine entertainment, knowledge and appreciation. The flat cardboard or wood boards can be assembled into various three-dimensional models or flat models without any auxiliary tools. Jigsaw puzzles have received great attention in families at home and abroad, which can cultivate children's sense of independence, focus on practice and thought abilities and guide children to think divergently and improve their imagination.

The traditional jigsaw puzzle tables on the market are generally fixed and cannot be rotated according to needs, which is very inconvenient to use. In addition, the height of the jigsaw puzzle table cannot be adjusted according to people of different heights, the adaptability is poor, which affects the effect of playing jigsaw puzzle.

Therefore, the present invention provides a liftable and rotatable jigsaw puzzle table to solve the above-mentioned problems.

SUMMARY OF THE DISCLOSURE

The present invention provides a liftable and rotatable jigsaw puzzle table, which effectively solves the problem that the traditional jigsaw puzzle table cannot be rotated, and the height of the jigsaw puzzle table cannot be adjusted according to people of different heights.

The technical solutions of the present invention are as follows:

A liftable and rotatable jigsaw puzzle table, includes a jigsaw bottom plate, a center member is fixedly provided on the bottom of the jigsaw bottom plate, a sleeve is fixedly installed in the middle of the center member, a fixed member is rotatably installed at the bottom of the jigsaw bottom plate, a sleeve rod is provided within the sleeve and is fixedly installed on the top of the fixed member, a ball bearing is rotatably provided on the bottom of the sleeve, an annular groove is provided at the bottom of the center member, a plurality of positioning holes are evenly provided in the annular groove, a positioning cylinder is fixedly installed on the fixed member, a positioning rod is slidably provided in the positioning cylinder and can slides up and down, a top pressure spring is fixedly installed on the bottom of the positioning rod, a top pipe is installed at the bottom of the fixed member, a bottom pipe is sleeved on the top pipe, and a gas spring is provided in the top pipe and the bottom pipe.

Preferably, a connecting frame is fixedly installed at the bottom of the fixed member, the top end of the top pipe is fixedly installed on the connecting frame, and a transverse plate is fixedly installed on the bottom of the bottom pipe.

Preferably, insertion plates are slidably provided on both ends of the transverse plate, an elastic plate is fixedly provided on each insertion plate within the transverse plate, and positioning holes are provided on the transverse plate.

Preferably, a stabilizing plate is fixedly provided on each of the insertion plates. Preferably, an adjustment rod is rotatably installed on the connecting frame.

Preferably, a jigsaw top plate is fixedly installed on the top of the puzzle base plate, and pull-out boxes are provided on the jigsaw top plate.

The beneficial effects of the present invention are as follows:

The jigsaw puzzle table of the present invention can be easily adjusted to the most suitable height and angle, which can be used conveniently at different angles, thereby improving convenience and efficiency, and improving user comfort and use flexibility.

DETAILED DESCRIPTION OF THE PREFERRED EMBODIMENTS

Figure 1:
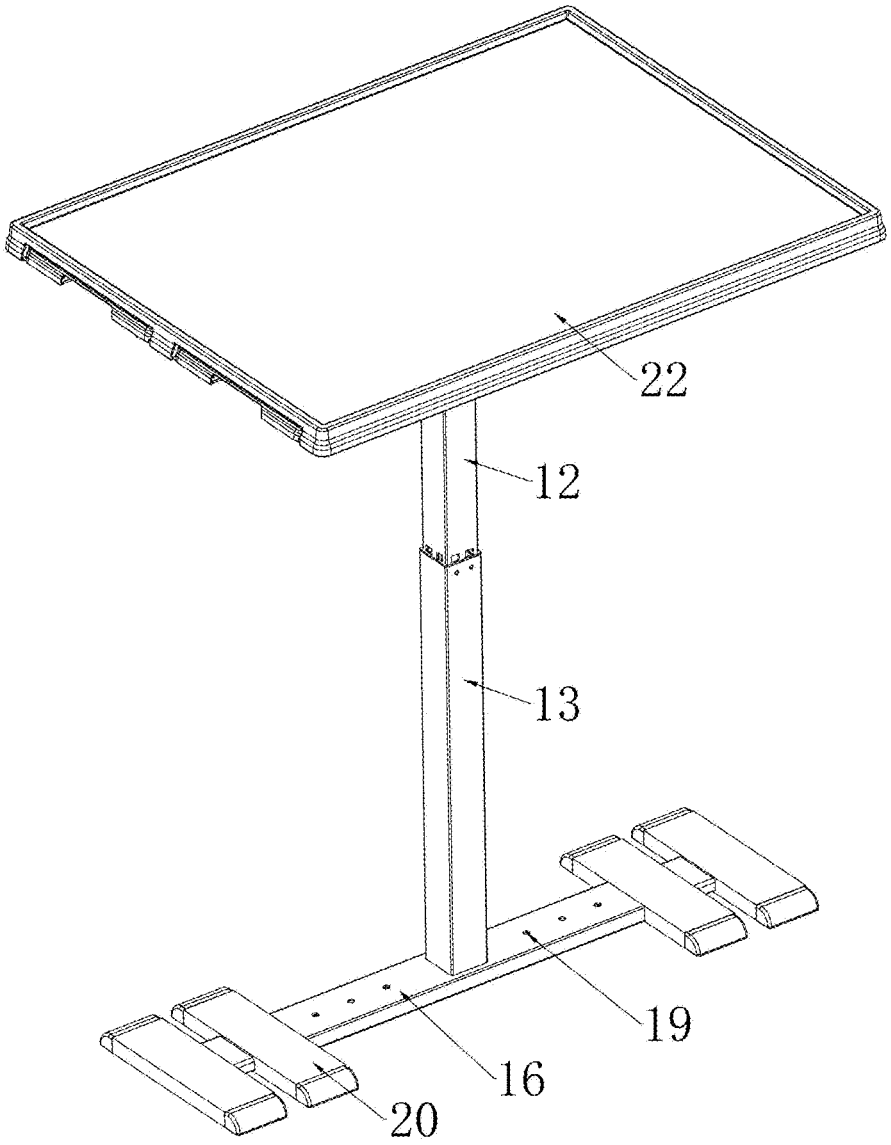
FIG. 1 is a perspective view of the present invention.
Figure 2:
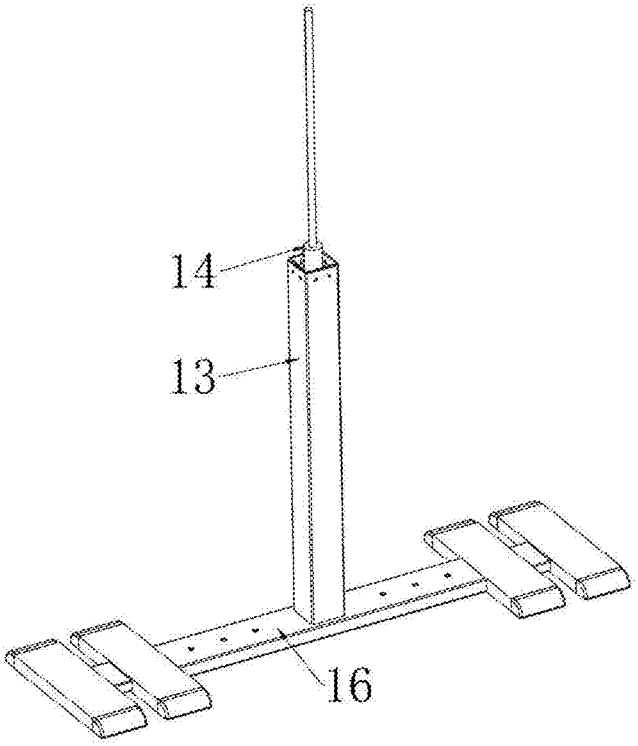
FIG. 2 is a schematic view of the installation position of the gas spring of the present invention.

Other features, objects and advantages of the present invention will be more clearly and completely by the detailed description of the non-limiting embodiments with reference to the attached drawings (FIG. 1 to FIG. 9). Obviously, the described embodiments are only part of the embodiments of the present invention, but not all of them. Based on the embodiments of the present invention, all other embodiments obtained by ordinary technicians in the field without creative labor are within the scope of the present invention.

A liftable and rotatable jigsaw puzzle table, as shown in FIGS. 1, 5, 7, 8, and 9, includes a jigsaw bottom plate 1, a central circular hole is provided in the middle of the jigsaw bottom plate 1, a center member 2 is fixedly installed in the central circular hole, a sleeve 3 protruding upward is fixedly installed in the middle of the center member 2, the top of the sleeve 3 is in a sealed state, a fixed member 4 is rotatably installed at the bottom of the jigsaw bottom plate 1, the fixed member 4 is provided below the center member 2, a sleeve rod 5 protruding upward is fixedly provided at the top center of the fixed member 4, a mounting groove is provided at the top of the sleeve rod 5, the sleeve rod 5 is rotatably installed in the sleeve 3, a ball bearing 6 is rotatably installed in the mounting groove, and the ball bearing 6 is rotatably installed within the inner side of the top of the sleeve 3; the structure of the ball bearing 6 makes a certain gap between the bottom surface of the center member 2 and the top surface of the fixed member 4; the bottom of the center member 2 is provided with an annular groove 7, a plurality of positioning holes 8 are evenly provided in the annular groove 7, the number of positioning holes 8 is provided according to needs, and the depth of the positioning holes 8 is greater than the depth of the annular groove 7; a positioning cylinder 9 is fixedly installed on the bottom end of the fixed member 4, the top end of the positioning cylinder 9 is mutually communicated with the fixed member 4, a positioning rod 10 is slidably provided in the positioning cylinder 9 and can slides up and down, the positioning rod 10 penetrates the fixed member 4, and the top end of the positioning rod 10 is provided in round surface. Under normal circumstances, the top round surface of the positioning rod 10 is provided in the corresponding positioning hole 8.

A top pressure spring 11 is fixedly provided on the bottom of the positioning rod 10, the bottom end of the top pressure spring 11 is fixedly installed on the bottom surface of the positioning cylinder 9, a top pipe 12 is installed on the bottom of the fixed member 4, a bottom pipe 13 is sleeved on the outer surface of the top pipe 12, the bottom pipe 13 can slide up and down along the top pipe 12, a gas spring 14 is provided inside the top pipe 12 and the bottom pipe 13, the bottom end of the gas spring 14 is fixedly installed on the bottom of the bottom pipe 13, and the gas spring 14 can be chosen from existing suitable components.

Figure 3:
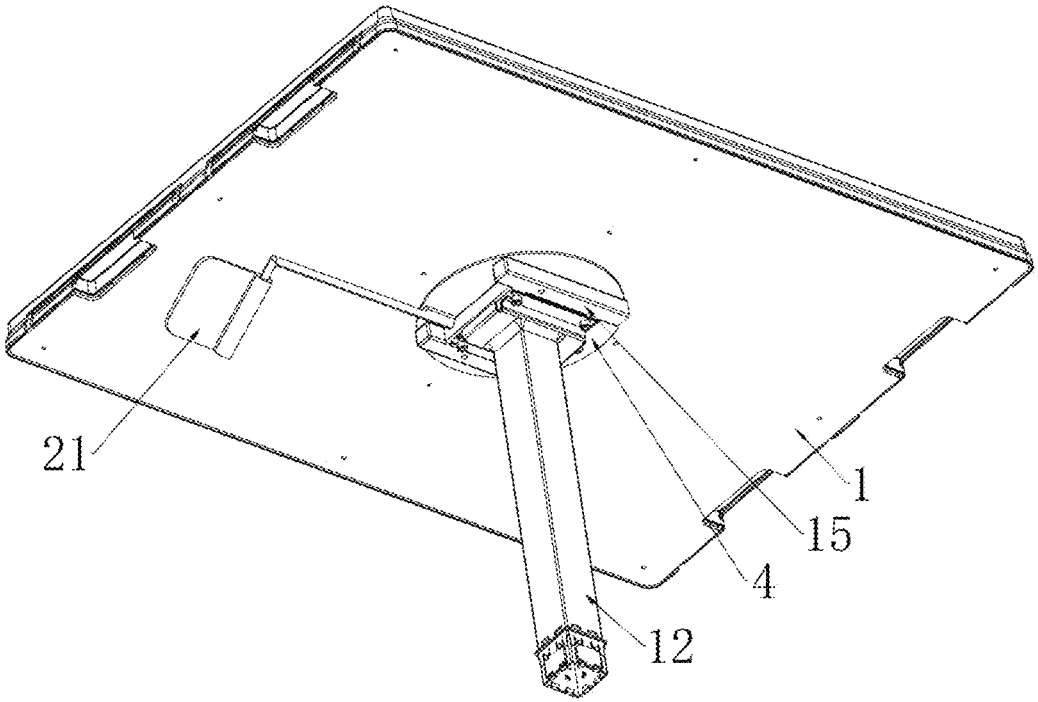
FIG. 3 is a schematic view of the installation position of the connecting frame of the present invention.

As shown in FIG. 3, a connecting frame 15 is fixedly installed at the bottom of the fixed member 4, the top end of the top pipe 12 is fixedly installed on the connecting frame 15, the bottom of the bottom pipe 13 is fixedly installed with a transverse plate 16, and the top end of the gas spring 14 is fixedly installed on the connecting frame 15.

Figure 6:
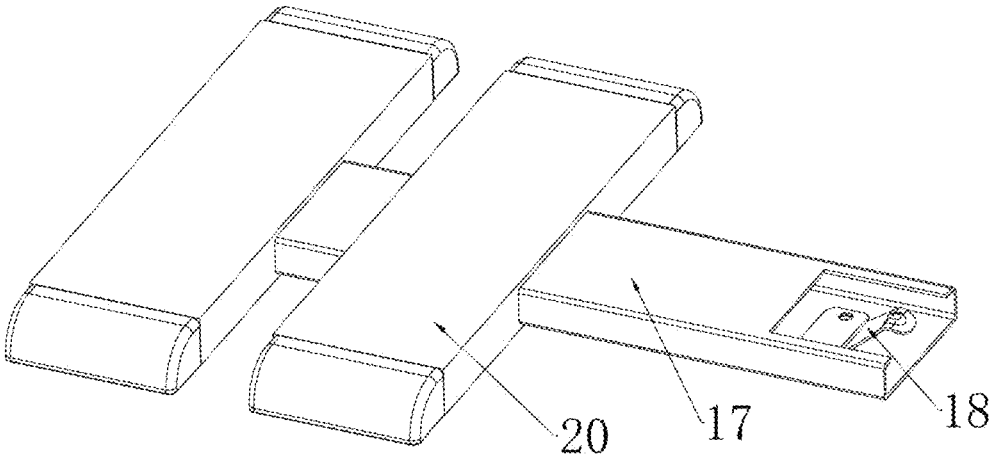
FIG. 6 is a schematic view of the installation position of the elastic plate of the present invention.
Figure 7:
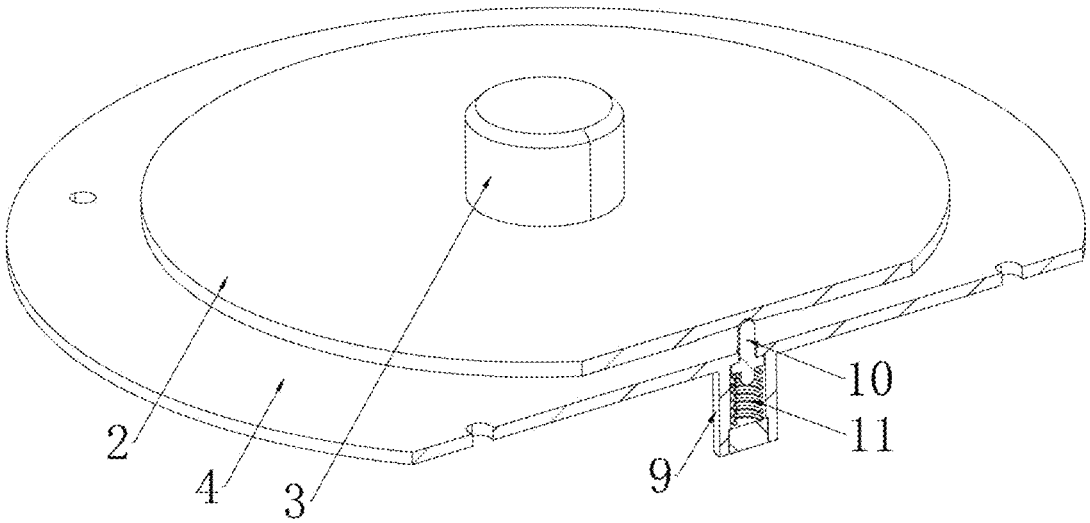
FIG. 7 is a schematic structural view of the positioning cylinder, the positioning rod, and the top pressure spring of the present invention.
Figure 8:
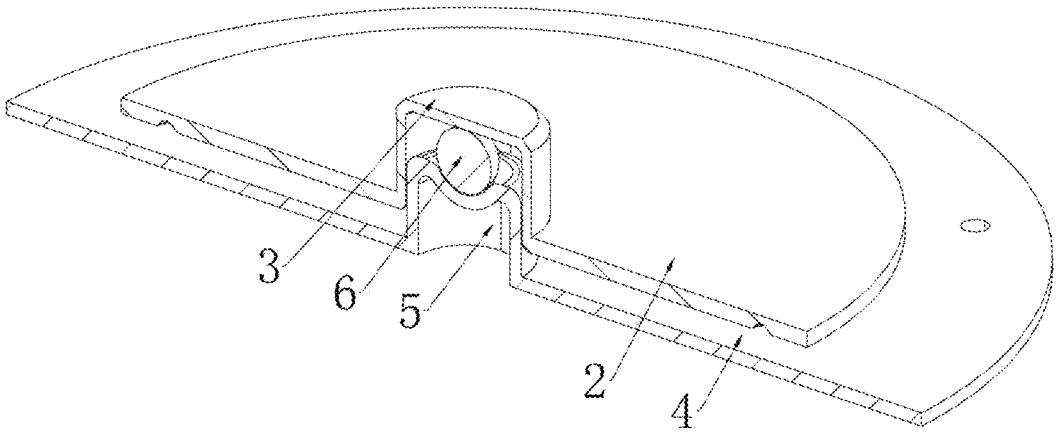
FIG. 8 is a schematic view of the installation position of the ball bearing of the present invention.
Figure 9:
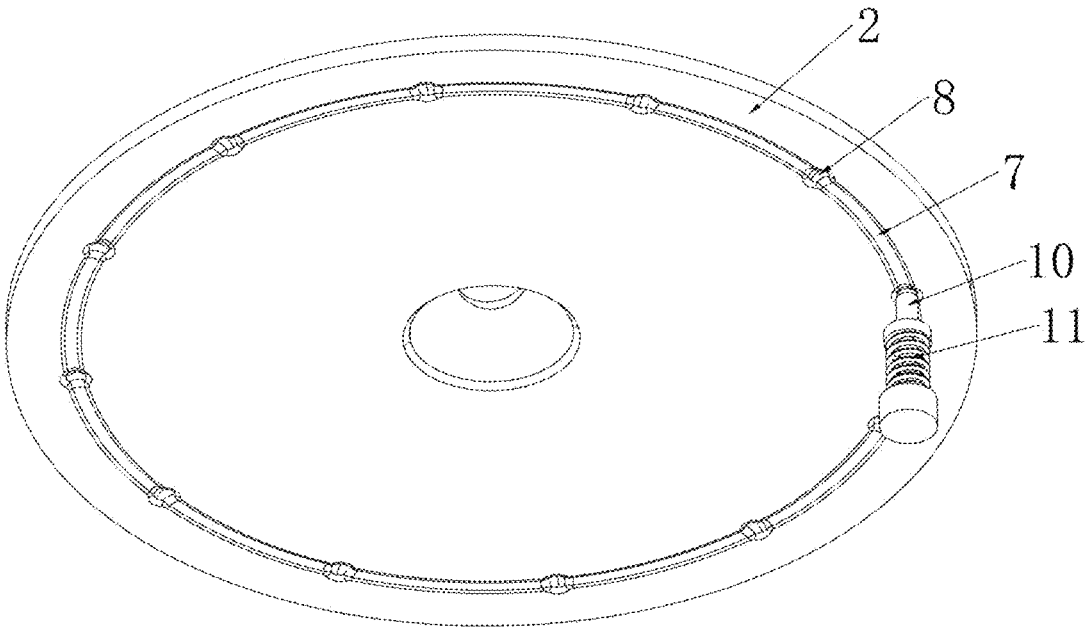
FIG. 9 is a schematic view of an annular groove of the present invention.

As shown in FIGS. 1 and 6, inner cavities are respectively opened at both ends of the transverse plate 16, an insertion plate 17 is slidably provided in each inner cavity and can slides left and right, an elastic plate 18 is fixedly provided on each insertion plate 17 within the inner cavities, and the elastic plate 18 can be chosen from an existing suitable metal elastic plate or other suitable components; a convex ball is fixedly provided on the top of the elastic plate 18, a plurality of positioning holes 19 that penetrate the inner cavity are respectively provided on both ends of the transverse plate 16, and the number of the positioning holes 19 is can be provided according to needs.

As shown in FIG. 6, a stabilizing plate 20 is fixedly provided on the outer end of each of the insertion plates 17, and the stabilizing plate 20 can improves the stability of the jigsaw puzzle table.

As shown in FIG. 3, an adjustment rod 21 is rotatably installed on the connecting frame 15, and a swing plate at the top of the gas spring 14 is fixedly installed on the adjustment rod 21.

Figure 4:
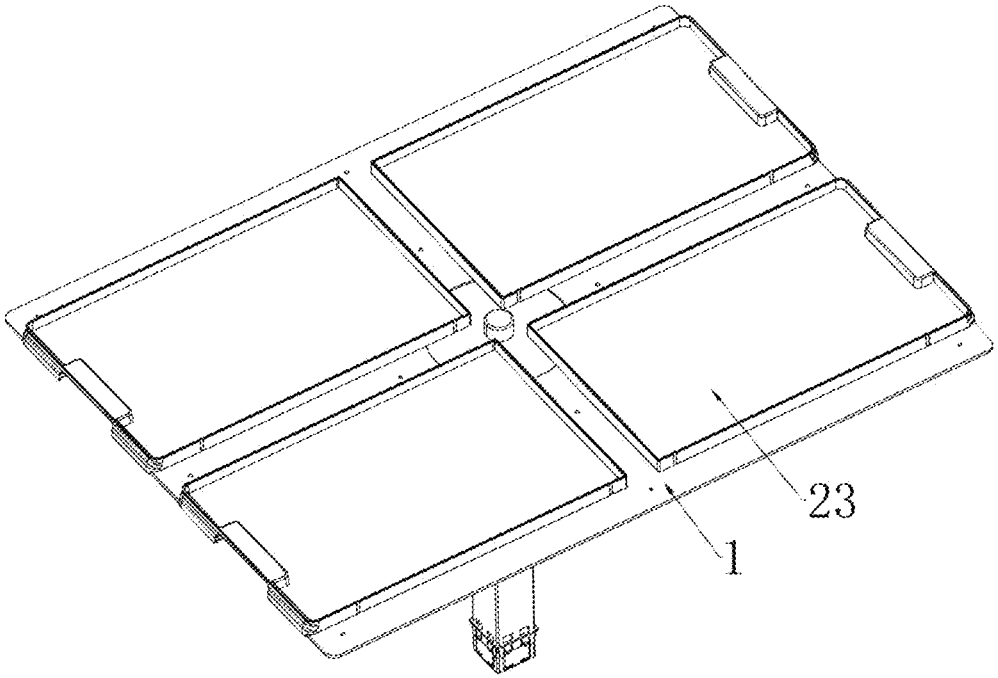
FIG. 4 is a schematic structural view of the pull-out box of the present invention.
Figure 5:
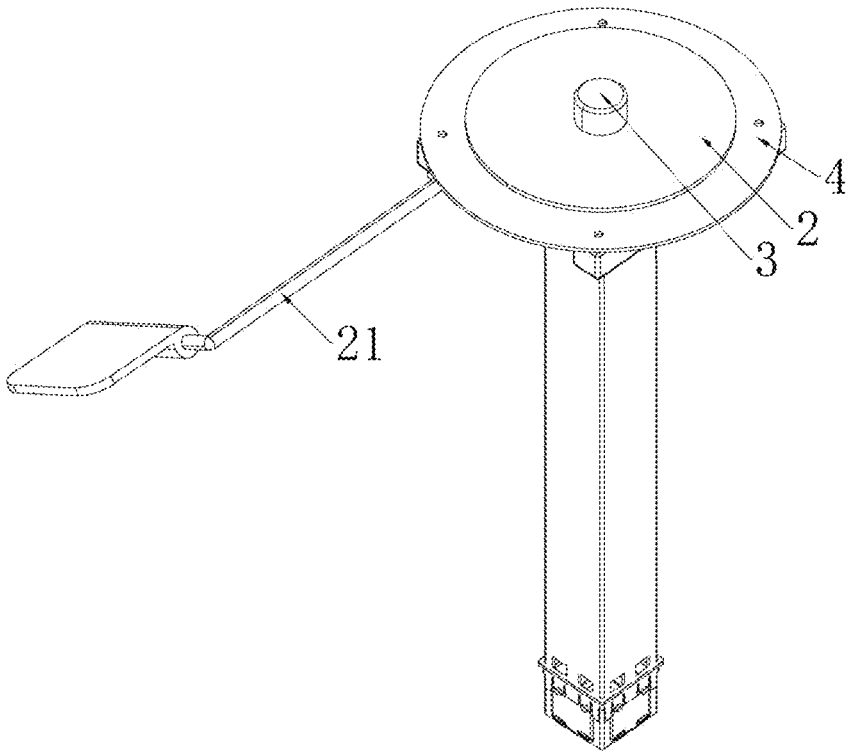
FIG. 5 is a schematic structural view of the center member, sleeve, and fixed member of the present invention.

As shown in FIG. 1 and FIG. 4, a jigsaw top plate 22 is fixedly installed on the top of the jigsaw bottom plate 1, and two pull-out openings are respectively provided at the left and right ends of the jigsaw top plate 22, a pull-out box 23 is slidably installed in each of the pull-out openings, and the sleeve 3 is provided between the four draw-out boxes 23.

The jigsaw puzzle table of the present invention can be easily adjusted to the most suitable height and angle, which can be used conveniently at different angles, thereby improving convenience and efficiency, and improving user comfort and use flexibility.

The working principle of the present invention is:

First, put the puzzle table in a suitable position, drive the two insertion plates 17 to slide away from each other along the inner cavity, and based on the elastic force of the elastic plate 18, the convex ball slides along the inner top surface of the inner cavity until the convex ball slides into the corresponding positioning hole 19, thereby limiting the insertion plates 17 and improving stability.

When the angle of the jigsaw top plate 22 needs to be adjusted, manually drive the the jigsaw top plate 22 to rotate, the sleeve 3 rotates along the ball bearing 6 and the sleeve rod 5, and the positioning rod 10 slides from the corresponding positioning hole 8 to the annular groove 7. Due to the depth of the positioning hole 8 is greater than the depth of the annular groove 7, the positioning rod 10 squeezes the top pressure spring 11 and compresses it until the positioning rod 10 gradually slides into another positioning hole 8. In addition, based on the rebound force of the top pressure spring 11, the positioning rod 10 can slides into the corresponding positioning hole 8 again, thereby realizing the adjustment of the angle of the jigsaw top plate 22 and the positioning function between the center member 2 and the fixed member 4. Based on a plurality of positioning holes 8, the angle of the jigsaw top plate 22 can be adjusted as needed, thereby improving the convenience of use.

When the jigsaw top plate 22 needs to be adjusted upward, manually rotate the adjustment rod 21, the swing plate opens the valve at the top of the gas spring 14, the gas spring 14 pushes the connecting frame 15 and the jigsaw top plate 22 to move upward, and the top pipe 12 slides upward along the bottom pipe 13 until the jigsaw top plate 22 is adjusted to a suitable height, and then the adjustment rod 21 is reversed, and the valve at the top of the gas spring 14 is closed. When the jigsaw top plate 22 needs to be adjusted downward, manually rotates the adjustment rod 21, the swing plate opens the valve at the top of the gas spring 14, then apply pressure downward to the jigsaw top plate 22, the gas spring 14 contracts and moves downward with the connecting frame 15 and the jigsaw top plate 22, and the top pipe 12 slides downward along the bottom pipe 13 until the jigsaw top plate 22 is adjusted to a suitable height, and then the adjustment rod 21 is reversed, and the valve at the top of the gas spring 14 is closed, so that the jigsaw top plate 22 can be adjusted to a suitable degree. In this way, the height of the jigsaw top plate 22 can be adjusted to satisfy the users of different heights and improve the convenience of use.

In the present invention, the use of orientation words such as "up", "bottom", "left", "right", "inner", and "outer" are only for the convenience of description, rather than indicating or implying the specific orientation, therefore it should not be construed as being limited to the description of the following embodiments. It is to be understood that the data so used are interchangeable under appropriate circumstances in order to describe the embodiments of the invention herein.

Unless otherwise stated, it should be noted that the terms "provided", "connected" and "installed" should be understood broadly. For example, the connection could be fixed connection, detachable connection, integral connection, mechanical connection, electrical connection, direct connection, indirect connection through the intermediate structure, or internal connection between two elements. For those of ordinary skill in this field, the specific meanings of the above terms in the present invention can be understood in specific situations.

In the present invention, the terms "comprises/includes" and the like in the description and claims of the present invention and the attached drawings are used to describe the technical features, numerical values, steps or components. One or more other features, numerical values, steps, components or their combinations based on this invention shall be included in the scope of protection of the present invention.

Hereinafter, embodiments of the present invention have been described in detail with reference to the accompanying drawings. While the description above refers to the particular embodiments of the present invention, it will be understood that many modifications may be made without departing from the spirit thereof. Any equivalent replacement or modification would fall within the protection scope of the present invention.

What is claimed is:

1. A liftable and rotatable jigsaw puzzle table, comprising a jigsaw bottom plate (1), a center member (2) fixedly provided on the bottom of the jigsaw bottom plate (1), a sleeve (3) fixedly installed in the middle of the center member (2), a fixed member (4) installed at the bottom of the jigsaw bottom plate (1), a sleeve rod (5) provided within the sleeve (3) and is fixedly installed on the top of the fixed member (4), a ball bearing (6) rotatably provided on the bottom of the sleeve (3), an annular groove (7) provided at the bottom of the center member (2), a plurality of positioning holes (8) evenly provided in the annular groove (7), a positioning cylinder (9) fixedly installed on the fixed member (4), a positioning rod (10) slidably provided in the positioning cylinder (9) and configured to slide up and down, a top pressure spring (11) fixedly installed on the bottom of the positioning rod (10), a top pipe (12) installed at the bottom of the fixed member (4), a bottom pipe (13) sleeved on the top pipe (12), and a gas spring (14) provided in the top pipe (12) and the bottom pipe (13).

2. The liftable and rotatable puzzle table according to claim 1, wherein a connecting frame (15) is fixedly installed at the bottom of the fixed member (4), the top end of the top pipe (12) is fixedly installed on the connecting frame (15), and a transverse plate (16) is fixedly installed on the bottom of the bottom pipe (13).

3. The liftable and rotatable puzzle table according to claim 2, wherein insertion plates (17) are slidably provided on both ends of the transverse plate (16), an elastic plate (18) is fixedly provided on each insertion plate (17) within the transverse plate (16), and positioning holes (19) are provided on the transverse plate (16).

4. The liftable and rotatable puzzle table according to claim 3, wherein a stabilizing plate (20) is fixedly provided on each of the insertion plates (17).

5. The liftable and rotatable puzzle table according to claim 2, wherein an adjustment rod (21) is rotatably installed on the connecting frame (15).

6. The liftable and rotatable puzzle table according to claim 1, wherein a jigsaw top plate (22) is fixedly installed on the top of the puzzle base plate (1), and pull-out boxes (23) are provided on the jigsaw top plate (22).

* * * * *